US008727205B2

(12) United States Patent
Wipf

(10) Patent No.: US 8,727,205 B2
(45) Date of Patent: May 20, 2014

(54) RECLOSABLE PACK

(75) Inventor: Alfred Wipf, Jestetten (DE)

(73) Assignee: Robert Bosch GmbH, Stuttgart (DE)

( * ) Notice: Subject to any disclaimer, the term of this patent is extended or adjusted under 35 U.S.C. 154(b) by 718 days.

(21) Appl. No.: 13/002,442

(22) PCT Filed: Jun. 12, 2009

(86) PCT No.: PCT/EP2009/057286
§ 371 (c)(1),
(2), (4) Date: Feb. 11, 2011

(87) PCT Pub. No.: WO2010/000595
PCT Pub. Date: Jan. 7, 2010

(65) Prior Publication Data

US 2011/0139864 A1 Jun. 16, 2011

(30) Foreign Application Priority Data

Jul. 1, 2008 (DE) ..... 10 2008 040 046

(51) Int. Cl.
*B65D 5/38* (2006.01)
*B64D 43/02* (2006.01)

(52) U.S. Cl.
USPC ..... 229/125.125; 229/122; 229/123.1

(58) Field of Classification Search
USPC ..... 229/87.05, 87.08, 122, 123.1, 123.2, 229/125.12, 125.125, 129.1, 245; 426/119
See application file for complete search history.

(56) References Cited

U.S. PATENT DOCUMENTS

| | | | | |
|---|---|---|---|---|
| 2,413,923 | A * | 1/1947 | Kackley et al. | 229/125.12 |
| 3,049,224 | A * | 8/1962 | Fredette et al. | 229/125.12 |
| 3,768,719 | A * | 10/1973 | Johnson | 229/123.1 |
| 4,573,614 | A * | 3/1986 | Ozawa | 222/542 |
| 4,779,793 | A * | 10/1988 | Runo et al. | 229/125.12 |
| 4,944,408 | A * | 7/1990 | Rausing | 229/242 |
| 5,269,404 | A | 12/1993 | Wischusen, III et al. | |
| 5,791,465 | A | 8/1998 | Niki et al. | |
| 6,062,468 | A * | 5/2000 | Tausanovitch | 229/123.1 |
| 7,040,528 | B2 * | 5/2006 | Hengami | 229/125.12 |
| 2006/0144911 | A1 * | 7/2006 | Sierra-Gomez et al. | 229/123.1 |

FOREIGN PATENT DOCUMENTS

GB 2310187 A 8/1997

* cited by examiner

*Primary Examiner* — Gary Elkins
(74) *Attorney, Agent, or Firm* — Michael Best & Friedrich LLP

(57) ABSTRACT

A reclosable pack according to the invention has a container with a covering film or foil as a closure part which covers a removal opening, which closure part is at least partially connected to the container, by a permanent adhesive, via an edge region adjoining the removal opening, and is made from a flexible material. Advantageously it is therefore possible to detach the closure part in order to release the removal opening by pulling in the pulling direction of the container and to place it back on the container in the opposite direction in order to reclose the removal opening. The container is surrounded by an outer pack which can be displaced in relation to the container in the pulling direction and in the opposite direction, and the closure part is fastened to the outer pack such that the release and reclosing of the removal opening can be controlled by displacing the outer pack in the pulling direction or in the opposite direction.

16 Claims, 4 Drawing Sheets

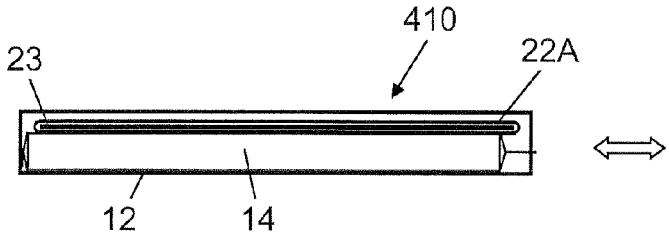
Fig. 15
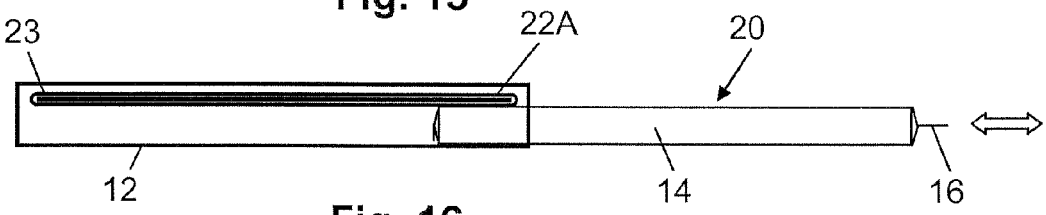
Fig. 16
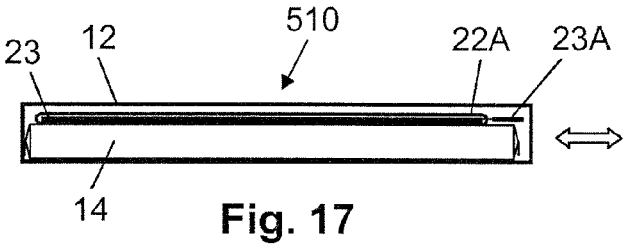
Fig. 17
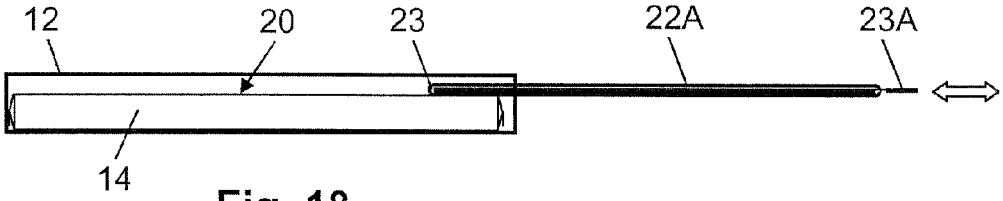
Fig. 18
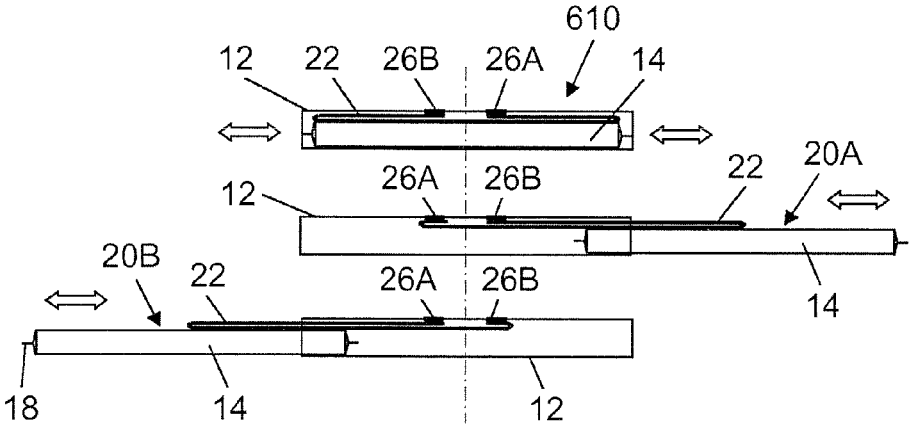
Fig. 19
Fig. 20
Fig. 21

RECLOSABLE PACK

CROSS-REFERENCE TO RELATED APPLICATION

This application is a 35 USC 371 application of PCT/EP 2009/057286 filed on Jun. 12, 2009.

BACKGROUND OF THE INVENTION

1. Field of the Invention

The invention relates to a reclosable pack having a container with a closure part of a flexible material, which closure part covers a removal opening and is joined to the container via a peripheral region adjoining the removal opening; the closure part, for opening the removal opening, is detachable from the container by being pulled in the pulling direction and, for reclosing the removal opening, can be applied to the container again in the opposite direction.

2. Description of the Prior Art

From United States published patent application 2005/0276425 A1, a bag pack is known, comprising a laminate with a reclosure system integrated into the laminate, with a closure strip that covers a removal opening and that is to be pulled off from the pack to open it. After the pack is first opened, a peripheral zone lined with a permanent adhesive remains on the closure strip. When the closure part is folded back and applied to the pack, the result is a detachable adhesive bonding of the closure strip to a peripheral region adjoining the removal opening.

From European Patent Disclosure EP 1 886 934 A2, a further bag package is known, with a reclosure system known from US 2005/0276525 A1. When the pack is opened for the first time, by pulling the closure strip away, an inner part serving as a warranty of the pack's being opened for the first time is simultaneously separated from the rest of the packaging laminate, in such a way that this inner part is no longer visible from outside.

From U.S. Pat. No. 4,260,061, a reclosable package with a hinged lid is known. A peripheral region of the package, adoining the removal opening, is lined with a permanent adhesive. When the lid is folded back onto the package, a peripheral zone of the hinged lid is applied to the peripheral region, provided with the permanent adhesive, of the package and is detachably glued to this peripheral region.

From U.S. Pat. No. 6,557,700 B1, a package with an encompassing band, disposed inside an outer pack, is known as an aid in opening the package. On the encompassing band, a pull-out tab is affixed to one side and an open container is affixed to the other side, in such a way that when the pull-out tab is pulled out on one side of the outer pack, the container on the other side is pushed out of the outer pack, counter to the direction in which the tab is pulled out.

European Patent Disclosure EP 1 534 597 B1 discloses a childproof package, with an outer pack and with an open container that can be inserted into the outer pack. The container is provided on opposed side walls with stop tabs which, together with corresponding openings in the outer pack, upon complete insertion into the outer pack form blocking elements which make it possible to open the package only by simultaneously pressing the stop tabs inward.

A substantial disadvantage of known reclosable packages with a flexible closure strip is that this type of package is not childproof. Also, if the closure strip is applied to the package in an uncontrolled way, creasing of the closure strip can easily occur upon reclosure, thus causing the package to leak. Moreover, both hands are needed for removing the product from the package—one hand for keeping the closure strip in its open position, and the other for pulling the product out of the package. A reclosable pack of the type defined at the outset is known from U.S. Pat. No. 5,269,404 A.

OBJECTS AND SUMMARY OF THE INVENTION

It is the object of the invention to create a reclosable pack of the type defined at the outset. The pack should in particular be suitable for packages on the basis of a bag package or other flexible bag, with a flexible closure strip, but also for a shell-like container, such as a tray that is closed with a covering film or foil. The pack should make it possible to attach both a childproofing device and an originality seal that serves to warrant that the package has not yet been opened.

A further object of the invention is to create a reclosure system, in which the closing is done in a controlled way and thus is as free of creasing as possible, so that even after being reclosed, the pack is still virtually leakproof in the prevailing conditions.

This object is attained according to the invention in that the container is surrounded by an outer pack, which is displaceable relative to the container in the pulling direction and in the opposite direction, and the closure part is affixed to the outer pack in such a way that the opening and reclosing the removal opening are adjustable by displacing the outer pack in the pulling direction and in the opposite direction, respectively.

In most cases, the closure part is a closure strip. It can be glued, in the form of a label, detachably onto the surface of the container. It is also possible, however, for the closure part, together with the permanent adhesive and including an overlapping adhesive surface, to be integrated with a film laminate from which the container, such as a bag package, is formed, and for the closure part to be separable from the laminate via suitably disposed weakening lines or perforations the first time the pack is opened. By suitable auxiliary components of the outer pack, the closure part makes repeated opening and closing of the pack possible. The outer pack comprises a cardboard, for instance, into which a bag package is inserted. The label, or the closure strip integrated with the foil laminate of the bag package, is in that case fastened by one end to the top side of the outer pack. If the bag package is then pulled out, the label, or the closure strip integrated with the foil laminate, is detached rearward, and the opening in the pack is uncovered.

The outer pack can be embodied in tubular fashion, and the container can be a bag pack.

The outer pack can also be embodied in boxlike form with an opening located at the top. In that case, the closure part is preferably affixed to at least one slide that is displaceable across the opening. In that case, the container is preferably a tray that is closed with a covering film or foil.

The outer pack can also comprise at least one ring, for instance of cardboard, that is placed around a container, in particular a bag pack, and that is displaceable in a longitudinal direction of the container, and the closure strip is affixed to the at least one ring.

The closure part can also be an endless closure strip, in the form of an encompassing band. In a variant, the endless closure strip is affixed to the outer pack via an adhesive point.

The closing of the container can be done with a controlled pressure of the closure strip onto the adhesive surface; for that purpose, the container should have sufficient inherent stability that the requisite counterpressure can be built up.

For exerting a defined pressure on the closure part when it is applied to the container for reclosing the removal opening, the container is preferably dimensionally stable. The dimensional stability can be attained with an open container or tray of a dimensionally stable container material. Especially with bag packs of highly flexible material, it can be practical to provide a dimensionally stable inner part, such as a container or tray that is open at the top.

If the container itself comprises a flexible film or foil material, then the closure part can be part of the flexible film or foil material of the container.

The outer pack can be made childproof by one of the known methods, so that children are unable to open the pack in the described manner.

An originality seal can be added, for instance by using a label in which opening, once it has occurred, is made apparent by an imprint that becomes visible, as in EP 1 886 934, for instance.

The reclosable pack of the invention has the following advantages, among others:

- Defined opening and closing with auxiliary means of the outer pack ensures virtually leakproof reclosure. Thus the protection of the product is guaranteed even after the package has been opened.
- A childproofing means can be integrated.
- An originality seal can be integrated.
- The original pack can be embodied as a leakproof pack.
- The pack can be opened and closed, and the product can be removed, with only one hand.
- The pack is well protected against being opened unintentionally.
- Great potential for differentiation among known styles of pack.
- Can be used for flexible packs with a label and for trays with a covering film or foil, among other purposes.
- Since the pack is leakproof as shipped, and meets requirements for leakproofness even when it has been used, it can be used as a substitute for initial and multiple packaging.

BRIEF DESCRIPTION OF THE DRAWINGS

Further advantages, characteristics and details of the invention will become apparent from the ensuing description of preferred exemplary embodiments and in conjunction with the drawings, in which the following are schematically shown:

FIG. 15, a longitudinal section through a pack with an outer pack and a bag with an encompassing band as the closure part;

FIG. 16, a longitudinal section through the open pack of FIG. 15;

FIG. 17, a longitudinal section through a variant of the pack shown in FIG. 15, with an outer pack and a bag with an encompassing band as the closure part;

FIG. 18, a longitudinal section through the open pack of FIG. 17;

FIG. 19, a longitudinal section through a pack with an outer pack and a bag with a fixed band as the closure part; and FIGS. 20, 21, the pack of FIG. 19, in two open states.

DESCRIPTION OF THE PREFERRED EMBODIMENTS

Figure 1:
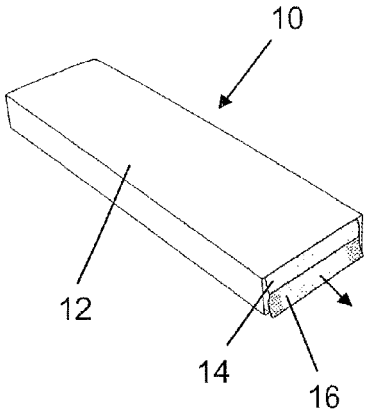
FIG. 1, an oblique view of a pack with an outer pack and with a bag package inserted.
Figure 2:
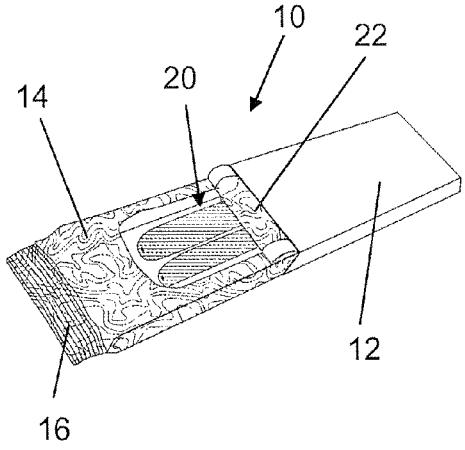
FIG. 2, the pack of FIG. 1, with the bag package partly pulled out of the outer pack and opened.
Figure 3:
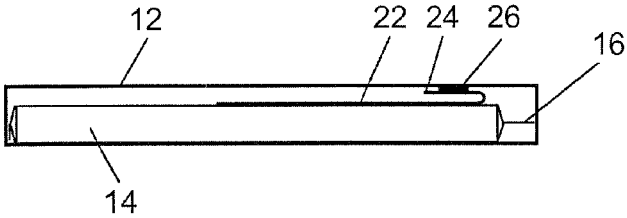
FIG. 3, a longitudinal section through the pack of FIG. 1.
Figure 4:
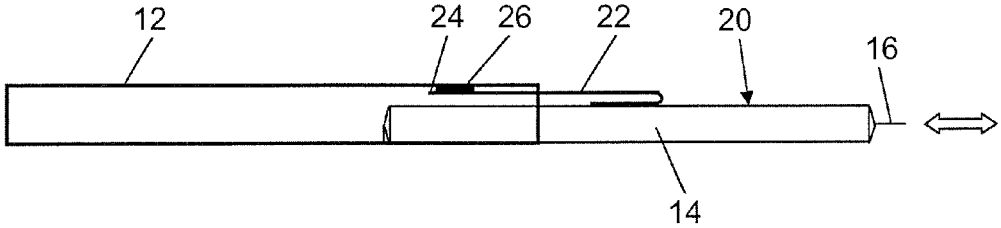
FIG. 4, a longitudinal section through the opened pack of FIG. 2.
Figure 5:
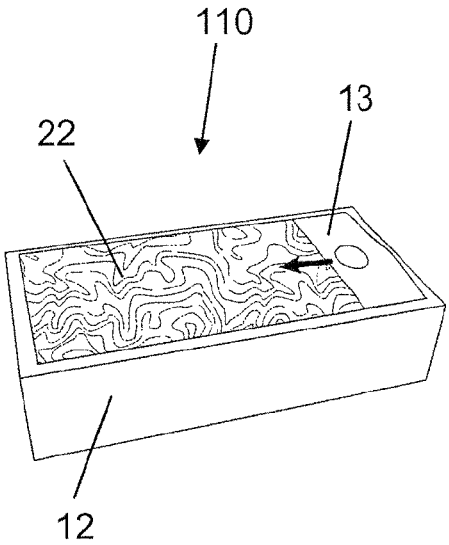
FIG. 5, an outer pack with a movable slide and a container that has been partly opened.
Figure 6:
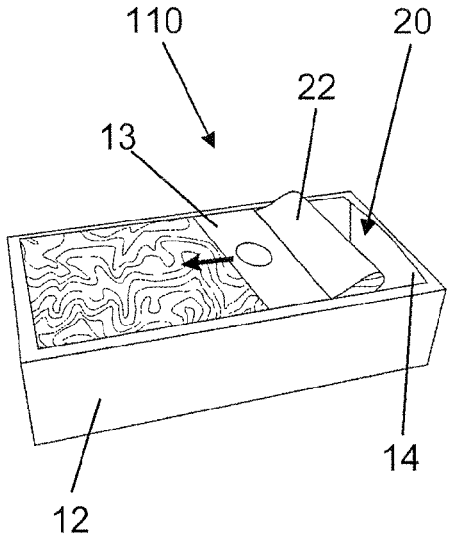
FIG. 6, the pack of FIG. 5, with the slide displaced and with the container partly opened.
Figure 7:
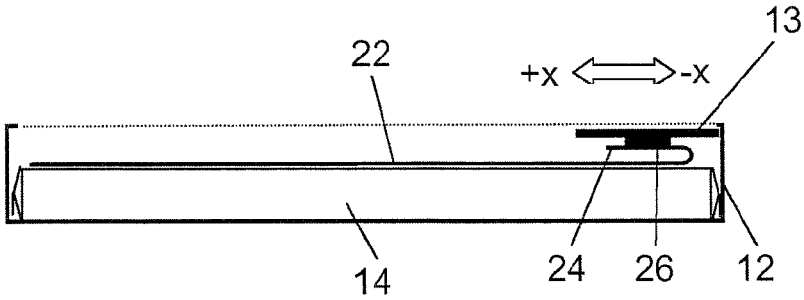
FIG. 7, a longitudinal section through the pack of FIG. 5.
Figure 8:
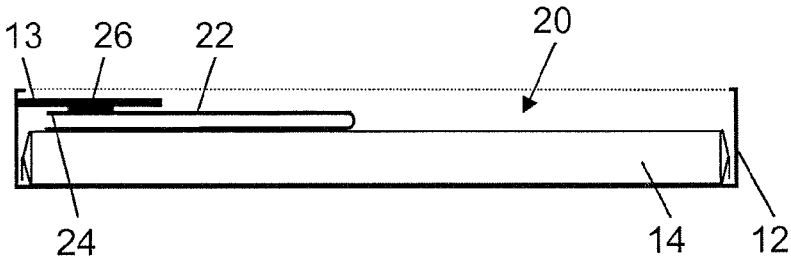
FIG. 8, a longitudinal section through the opened pack of FIG. 5.

A reclosable pack 10 shown in FIGS. 1-4 comprises a tubular outer pack 12, closed on one end, with a rectangular opening cross section. A container 14, here embodied as a bag package is inserted into the outer pack 12, and one crosswise sealing seam 16 of the bag package protrudes as a pull tab from the outer pack 12. The container 14 is provided with a film- or foil-like closure strip or closure label, covering film or foil 22 that covers a removal opening 20. The covering film or foil 22, in a peripheral zone protruding past the edge of the removal opening 20, is provided with a permanent adhesive and is detachably glued to the container 14. The covering film or foil 22 has a tear-open tab 24, secured to the inside of the outer pack 12 across an adhesive point 26. As shown in FIGS. 3 and 4, when the container 14 is pulled out of the outer pack 12, the covering film or foil 22 is detached from the container 14 and in the process uncovers the removal opening 20. When the container 14 is pushed back into the outer pack 12, the covering film or foil 22 is put back across the removal opening 20 in a controlled manner and sticks to the container 14 again.

The pack 110 shown in FIGS. 5-8 has an outer pack 12, in the form of a box open at the top, with a slide 13 that is displaceable in the pulling direction +x in the vicinity of the opening edge. A container 14 with a covering film or foil 22 that is reclosable via a permanent adhesive and that covers a removal opening 20 is disposed in the outer pack 12. As can be seen from FIGS. 7 and 8, a tear-open tab 24 of the covering film or foil 22 is secured to the underside of the slide via an adhesive point 26. When the slide 13 is displaced in the pulling direction +x, the covering film or foil 22 becomes detached from the container 14 and in the process uncovers the removal opening 20. When the slide 13 is pushed back in the opposite direction −x, the covering film or foil 22 is put back over the removal opening 20 again in a controlled way and sticks to the container 14 again.

The slide 13 shown in FIGS. 5-8, which is displaceable inside an opening frame, covers only a small part of the outer pack 12 that is open at the top, so that a large part of the container 14 is visible and exposed, even when the pack is closed. In a variant not shown, the slide 13 covers the opening of the boxlike outer pack 12 completely, and the container 14 is protected when the slide is closed. In that case, the slide 13 can be pulled laterally out of the outer pack 12, opening the container 14 practically completely.

Figure 9:
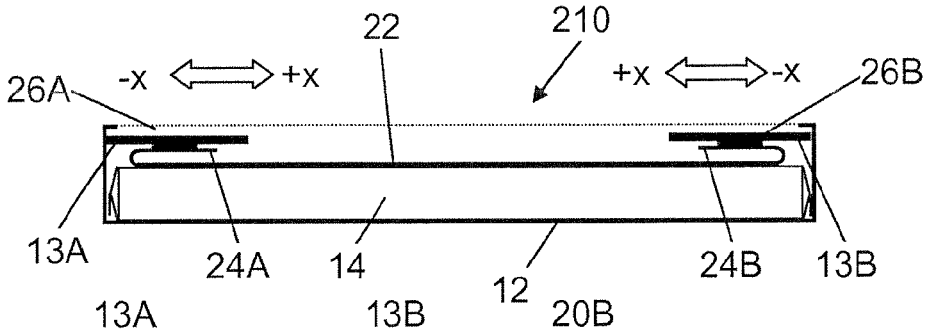
FIG. 9, a longitudinal section through a variant of the pack shown in FIG. 5, with two slides.
Figure 10:
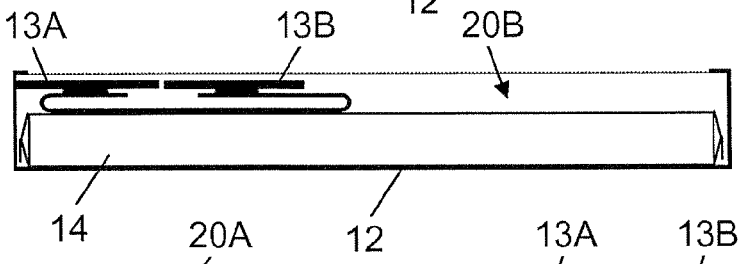
FIGS. 10, 11, the pack of FIG. 9, in two open states.
Figure 11:
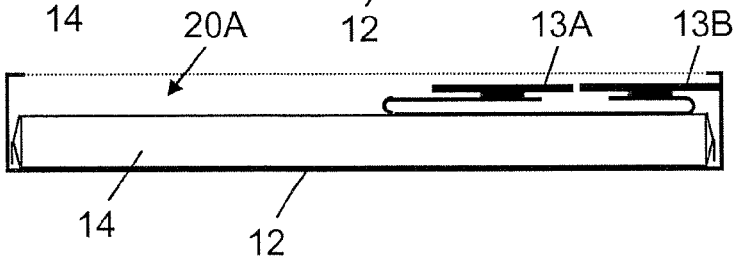

In the variant, shown in FIGS. 9-11, of the type of package shown in FIGS. 5-8, two slides 13A, 13B are provided for one pack 210. The covering film or foil 22 is joined to the two slides 13A, 13B on two opposed ends, each via a respective tear-open tab 24A, 24B secured to the underside of each slide 13A, 13B by means of a respective adhesive point 26A, 26B. In this way, the container 14 can be opened from either end by opening a removal opening 20A or 20B and can be closed again on both ends.

Figure 12:
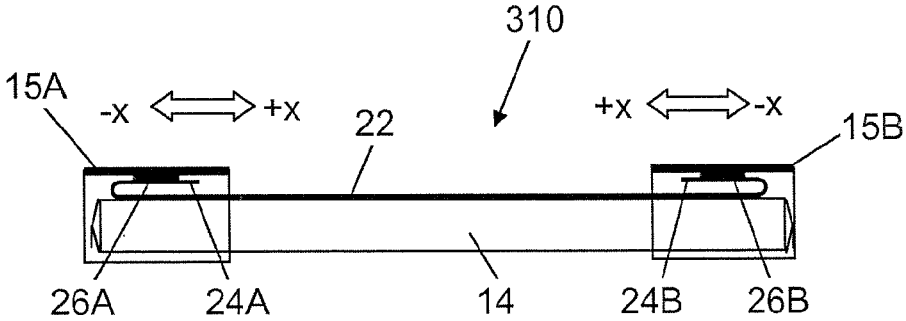
FIG. 12, a longitudinal section through a pack with two annularly disposed slides.
Figure 13:
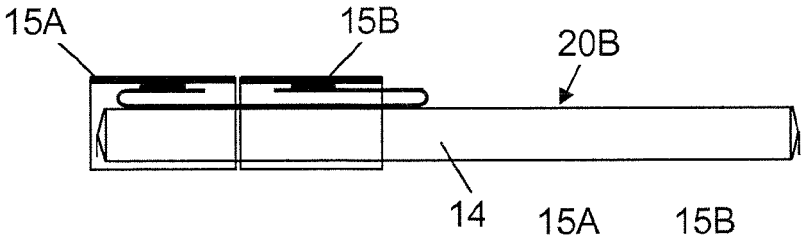
FIGS. 13, 14, the pack of FIG. 12, in two open states.
Figure 14:
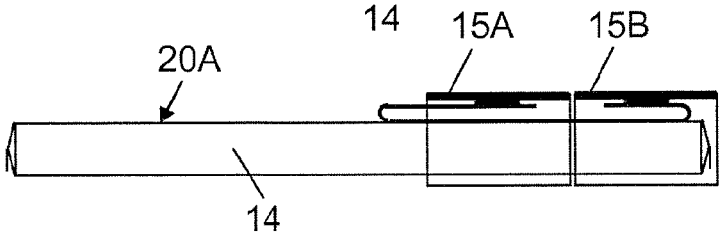

In the variant, shown in FIGS. 12-14, of the type of package shown in FIGS. 9-11, two rings 15A, 15B placed around a container 14, here embodied as a bag package take on the function of slides. Each of the two rings 15A, 15B is joined on the inside to the tear-open tab 24A, 24B of a covering film or foil 22, here embodied as a closure strip. Displacing the rings 15A, 15B in the longitudinal axis of the container 14 in the pulling direction +x makes it possible to open the pack from either end, by uncovering a respective removal opening 20A and 20B, and to close it again by displacing the rings 15A, 15B in the opposite direction −x.

In a variant, shown in FIGS. 15 and 16, of the type of package shown in FIGS. 1-4, reclosability for a pack 410 is provided in the form of an encompassing band or endless closure strip or closure label 22A. In the same way as the covering film or foil 22, embodied as a closure strip, the endless closure strip 22A is provided with a permanent adhesive in a peripheral zone that protrudes past the edge of the removal opening 20 and is detachably glued to the container 14, here embodied as a bag package. The endless closure strip 22A is guided inside the outer pack 12, sliding around a flat insert part 23, and extends in the form of a flat endless loop over practically the entire length of the outer pack 12. In this case, the removal opening 20 of the container 14 also extends over practically the entire length of the container 14. When the container 14 is pulled out of the outer pack 12, the endless closure strip 22A becomes detached from the container 14 and in the process uncovers the removal opening 20. When the container 14 is pushed back into the outer pack 12, the endless closure strip 22A is placed back over the removal opening 20 in a controlled way and sticks to the container 14 again.

In a variant, shown in FIGS. 17 and 18, of the type of package shown in FIGS. 15 and 16, for a pack 510 the flat insert part 23 can be pulled out of the outer pack 12 with the endless closure strip 22A by means of a pull-out tab 23A, uncovering the removal opening 20 of the container 14, here embodied as a bag package, and in this case the container 14 remains in the outer pack 12 that is open at the top. Here as well, the removal opening 20 of the container 14 extends over practically the entire length of the container 14. When the insert part 23 is pushed back, with the endless closure strip 22A, into the outer pack 12, the endless closure strip 22A is placed back over the removal opening 20 in a controlled way and sticks to the container 14 again.

In a variant, shown in FIG. 19, of the type of package shown in FIGS. 15-18, for a pack 610, instead of a endless closure strip, a covering film or foil 22, embodied as a closure strip shaped into a loop is joined by both ends, each via a respective adhesive point 26A, 26B, to the outer pack 12 on both sides of the longitudinal center of the outer pack. Instead of an open loop with two fixed ends, it is understood that it is also possible to use an endless closure strip, joined to the outer pack 12 in the vicinity of the longitudinal center of the outer pack. The outer pack 12, open on both face ends, now makes it possible to pull the container 14, here embodied as a bag package out of the outer pack 12 at each of the crosswise sealing seams 16, 18, and to open the package from correspondingly opposite ends. The covering film or foil 22, fixed only on both sides of the longitudinal center of the outer pack 12 via the adhesive points 26A, 26B, extends over practically the entire length of the outer pack 12. When the container 14 is pulled out of the outer pack 12, the covering film or foil 22 becomes detached from the bag package 14 and in so doing uncovers a removal opening 20A or 20B each over approximately half the length of the container 14. When the container 14 is pushed back into the outer pack 12, the covering film or foil 22 is placed back over the removal opening 20A or 20B in a controlled way and sticks to the container 14 again.

Upon closure, because of the stability of the film or foil laminate in combination with the small radius of deflection, the film or foil rolls cleanly over the closure window, even as the film or foil is being displaced in the closing process.

One example of a material that is suitable for outer packs and insert parts is cardboard, optionally coated with plastic, printed, and/or painted. Dimensionally stable containers may for instance comprise plastic-coated or uncoated aluminum foil. Bag packages comprise an optionally metallized, printed and/or painted plastic film, or a plastic laminate, for instance. As the permanent adhesive, all pressure-sensitive adhesives (PSAs) can be used, including hot-melt-based adhesives.

The foregoing relates to the preferred exemplary embodiments of the invention, it being understood that other variants and embodiments thereof are possible within the spirit and scope of the invention, the latter being defined by the appended claims.

The invention claimed is:

1. A reclosable pack having a container with a closure part of a flexible material, which closure part covers a removal opening and is joined to the container via a peripheral region adjoining the removal opening, the closure part, for opening the removal opening, being detachable from the container by being pulled in a pulling direction and, for reclosing the removal opening, being capable of being applied to the container again in an opposite direction from the pulling direction, which reclosable pack the container is surrounded by a tubular outer pack, which is displaceable relative to the container in the pulling direction and in the opposite direction, and the closure part is affixed to an inside of the outer pack in such a way that the opening and the reclosing of the removal opening are adjustable by displacing the outer pack in the pulling direction and in the opposite direction, respectively, wherein the container is a bag package of a flexible film or foil material, having a crosswise sealing seam acting as a pull tab, and the closure part is (a) glued detachably, in the form of a label of flexible film or foil material, to the bag package, or (b) part of the flexible film or foil material of the bag package, or (c) part of the flexible film or foil material, constructed as a multi-layer laminate, and the closure part together with a permanent adhesive is integrated into the laminate and can be separated from of the laminate, via weakening lines or perforations, when the pack is first opened.

2. The reclosable pack as defined by claim 1, wherein the closure part is a label of a flexible film or foil material.

3. The reclosable pack as defined by claim 1, wherein for exerting a defined pressure on the closure part on application to the container, the container is embodied as dimensionally stable for reclosing the removal opening, or is equipped with a dimensionally stable inner container.

4. The reclosable pack as defined by claim 2, wherein for exerting a defined pressure on the closure part on application to the container, the container is embodied as dimensionally stable for reclosing the removal opening, or is equipped with a dimensionally stable inner container.

5. A reclosable pack having a container with a closure part of a flexible material, which closure part covers a removal opening and is joined to the container via a peripheral region adjoining the removal opening, the closure part, for opening the removal opening, being detachable from the container by being pulled in a pulling direction and, for reclosing the removal opening, being capable of being applied to the container again in an opposite direction from the pulling direction, in which reclosable pack the container is surrounded by an outer pack, which is displaceable relative to the container in the pulling direction and in the opposite direction, and the closure part is affixed to the outer pack in such a way that the opening and the reclosing of the removal opening are adjustable by displacing the outer pack in the pulling direction and in the opposite direction, respectively, wherein:

the outer pack is embodied in boxlike form with an opening located at a top, and the closure part is affixed to at least one slide that is displaceable across the opening; or the outer pack comprises at least one ring placed around a container embodied as a bag pack, and displaceable in a longitudinal direction of the container, and the closure part is affixed to the at least one ring; or the closure part is an endless closure strip embodied as an encompassing band preferably affixed to the outer pack via an adhesive point.

6. The reclosable pack as defined by claim 5, wherein the container comprises a flexible film or foil material.

7. The reclosable pack as defined by claim 6, wherein the closure part is part of the flexible film or foil material, embodied as a multi-layer laminate, of the container.

8. The reclosable pack as defined by claim 5, wherein the closure part is a label of a flexible film or foil material.

9. The reclosable pack as defined by claim 6, wherein the closure part is a label of a flexible film or foil material.

10. The reclosable pack as defined by claim 7, wherein the closure part is a label of a flexible film or foil material.

11. The reclosable pack as defined by claim 5, wherein for exerting a defined pressure on the closure part on application to the container, the container is embodied as dimensionally stable for reclosing the removal opening, or is equipped with a dimensionally stable inner container.

12. The reclosable pack as defined by claim 6, wherein for exerting a defined pressure on the closure part on application to the container, the container is embodied as dimensionally stable for reclosing the removal opening, or is equipped with a dimensionally stable inner container.

13. The reclosable pack as defined by claim 7, wherein for exerting a defined pressure on the closure part on application to the container, the container is embodied as dimensionally stable for reclosing the removal opening, or is equipped with a dimensionally stable inner container.

14. The reclosable pack as defined by claim 8, wherein for exerting a defined pressure on the closure part on application to the container, the container is embodied as dimensionally stable for reclosing the removal opening, or is equipped with a dimensionally stable inner container.

15. The reclosable pack as defined by claim 9, wherein for exerting a defined pressure on the closure part on application to the container, the container is embodied as dimensionally stable for reclosing the removal opening, or is equipped with a dimensionally stable inner container.

16. The reclosable pack as defined by claim 10, wherein for exerting a defined pressure on the closure part on application to the container, the container is embodied as dimensionally stable for reclosing the removal opening, or is equipped with a dimensionally stable inner container.

* * * * *